US010087687B2

(12) United States Patent
Gilmore et al.

(10) Patent No.: US 10,087,687 B2
(45) Date of Patent: Oct. 2, 2018

(54) SEAL SUB SYSTEM

(75) Inventors: David L. Gilmore, Baytown, TX (US); Stephen J. Walker, Houston, TX (US)

(73) Assignee: Cameron International Corporation, Houston, TX (US)

( * ) Notice: Subject to any disclaimer, the term of this patent is extended or adjusted under 35 U.S.C. 154(b) by 828 days.

(21) Appl. No.: 13/437,511

(22) Filed: Apr. 2, 2012

(65) Prior Publication Data

US 2013/0255956 A1 Oct. 3, 2013

(51) Int. Cl.

| | |
|---|---|
| ***E21B 17/01*** | (2006.01) |
| ***E21B 17/12*** | (2006.01) |
| ***F16L 21/00*** | (2006.01) |
| ***E21B 17/07*** | (2006.01) |
| ***E21B 17/08*** | (2006.01) |
| ***E21B 19/00*** | (2006.01) |

(52) U.S. Cl.
CPC ..... *E21B 17/07* (2013.01); *E21B 17/085* (2013.01); *E21B 19/004* (2013.01)

(58) Field of Classification Search
CPC ..... E21B 17/02; E21B 17/07; E21B 17/085; E21B 19/004; E21B 43/0107
USPC ..... 166/345, 360, 367; 285/370, 334.2, 397, 285/32, 115, 145.1, 356, 417
See application file for complete search history.

(56) References Cited

U.S. PATENT DOCUMENTS

| | | | | |
|---|---|---|---|---|
| 1,337,228 | A * | 4/1920 | Hoffman et al. | 285/32 |
| 4,043,575 | A * | 8/1977 | Roth | F16L 39/00 285/377 |
| 4,280,719 | A * | 7/1981 | Daniel et al. | 285/90 |
| 4,496,173 | A * | 1/1985 | Roche | E21B 17/085 285/24 |
| 4,550,936 | A * | 11/1985 | Haeber et al. | 285/26 |
| 4,708,513 | A * | 11/1987 | Roche | E21B 17/085 285/356 |
| 5,141,263 | A | 8/1992 | Varden | |
| 6,332,841 | B1 * | 12/2001 | Secord | 464/20 |
| 7,338,093 | B2 | 3/2008 | Bilstein | |
| 2003/0093857 | A1 | 5/2003 | Paterson | |
| 2004/0256096 | A1 * | 12/2004 | Adams | 166/85.1 |
| 2010/0319925 | A1 * | 12/2010 | Papon et al. | 166/345 |

(Continued)

FOREIGN PATENT DOCUMENTS

| | | | | |
|---|---|---|---|---|
| WO | 2008102175 | A1 | 8/2008 | |
| WO | WO 2010049602 | A1 * | 5/2010 | E21B 17/01 |

OTHER PUBLICATIONS

International Search Report and Written Opinion for PCT Application No. PCT/US2013/035001 filed Apr. 2, 2013.

(Continued)

*Primary Examiner* — Matthew R Buck
*Assistant Examiner* — Stacy N Lawson
(74) *Attorney, Agent, or Firm* — Helene Raybaud

(57) ABSTRACT

A seal sub system for the connection of fluid lines, including first and second fluid lines, each including a terminal end with an inner diameter. A seal sub includes an inner channel and first and second pin ends, one pin end removably insertable in the fluid line terminal end with the other pin end extending from the fluid line terminal end. A seal forms a seal between the seal sub and the inner diameter of the first fluid line terminal end. The extending pin end is configured to be inserted into the terminal end of the second fluid line to establish a sealed fluid connection between the first and second fluid lines.

21 Claims, 16 Drawing Sheets

(56) References Cited

U.S. PATENT DOCUMENTS

| | | | | |
|---|---|---|---|---|
| 2011/0017466 | A1* | 1/2011 | Averbuch et al. | 166/345 |
| 2011/0056701 | A1* | 3/2011 | Jones et al. | 166/378 |
| 2013/0020087 | A1* | 1/2013 | Guesnon | E21B 17/085 166/367 |

OTHER PUBLICATIONS

Grissom, Jay, et al. "Aluminum Alloy Subsea Risers," published 2009 for OTC, 2 pages.

* cited by examiner

SEAL SUB SYSTEM

BACKGROUND

Offshore oil and gas operations often utilize a wellhead housing supported on the ocean floor and a blowout preventer stack secured to the wellhead housing's upper end. A blowout preventer stack is an assemblage of blowout preventers and valves used to control well bore pressure. The upper end of the blowout preventer stack has an end connection or riser adapter (often referred to as a lower marine riser packer or LMRP) that allows the blowout preventer stack to be connected to a series of pipes, known as riser, riser string, or riser pipe. Each segment, or joint, of the riser string is connected in end to end relationship, allowing the riser string to extend upwardly to the drilling rig or drilling platform positioned at the ocean surface.

The riser string is supported at the ocean surface by the drilling rig. This support may, among other methods, take the form of a hydraulic tensioning system and telescoping (slip) joint that connect to the upper end of the riser string and maintain tension on the riser string. The telescoping joint is composed of a pair of concentric pipes, known as an inner and outer barrel, that are axially telescoping within each other. The lower end of the outer barrel connects to the upper end of the riser string. The hydraulic tensioning system connects to a tension ring secured on the exterior of the outer barrel of the telescoping joint and thereby applies tension to the riser string. The upper end of the inner barrel of the telescoping joint is connected to the drilling platform. The axial telescoping of the inner barrel within the outer barrel of the telescoping joint compensates for relative elevation changes between the rig and wellhead housing as the rig moves up or down in response to the ocean waves.

According to conventional practice, various auxiliary fluid lines are coupled to the exterior of the riser tube. Exemplary auxiliary fluid lines include choke, kill, booster, and clean water lines. Choke and kill lines typically extend from the drilling rig to the wellhead to provide fluid communication for well control and circulation. The choke line is in fluid communication with the borehole at the wellhead and may bypass the riser to vent gases or other formation fluids directly to the surface. According to conventional practice, a surface-mounted choke valve is connected to the terminal end of the choke conduit line. The downhole back pressure can be maintained substantially in equilibrium with the hydrostatic pressure of the column of drilling fluid in the riser annulus by adjusting the discharge rate through the choke valve.

The kill line is primarily used to control the density of the drilling mud. One method of controlling the density of the drilling mud is by the injection of relatively lighter drilling fluid through the kill line into the bottom of the riser to decrease the density of the drilling mud in the riser. On the other hand, if it is desired to increase mud density in the riser, a heavier drilling mud is injected through the kill line.

The booster line allows additional mud to be pumped to a desired location so as to increase fluid velocity above that point and thereby improve the conveyance of drill cuttings to the surface. The booster line can also be used to modify the density of the mud in the annulus. By pumping lighter or heavier mud through the booster line, the average mud density above the booster connection point can be varied. While the auxiliary lines provide pressure control means to supplement the hydrostatic control resulting from the fluid column in the riser, the riser tube itself provides the primary fluid conduit to the surface.

A hose or other fluid line connection to each auxiliary fluid line is provided at the telescoping joint via a pipe or equivalent fluid channel. The pipe is often curved or U-shaped, and is accordingly termed a "gooseneck" conduit. In the course of drilling operations, a gooseneck conduit may be detached from the riser, for example, for maintenance or to permit installing or uninstalling a section of the riser, and reattached to the riser to provide access to the auxiliary fluid lines. To install, the gooseneck conduits are typically coupled to the auxiliary fluid lines via threaded connections that must be sealed. Additionally, the riser is typically made up of a number of sections, or joints, that extend from the LMRP to the ocean surface. The auxiliary fluid lines on each joint are connected with each other at the riser joint connections. Each of these connections must also be sealed to prevent fluid or pressure loss from the auxiliary lines.

These fluid line connections are typically integral or permanently attached with the auxiliary fluid lines themselves. If the connections need to be replaced or refurbished due to use or environmental corrosion of the seals or other parts, the entire fluid line for that section of riser or slip joint must be removed from the riser and replaced.

BRIEF DESCRIPTION OF THE DRAWINGS

For a detailed description of the preferred embodiments of the invention, reference will now be made to the accompanying drawings in which.

DETAILED DESCRIPTION

Figure 1A:
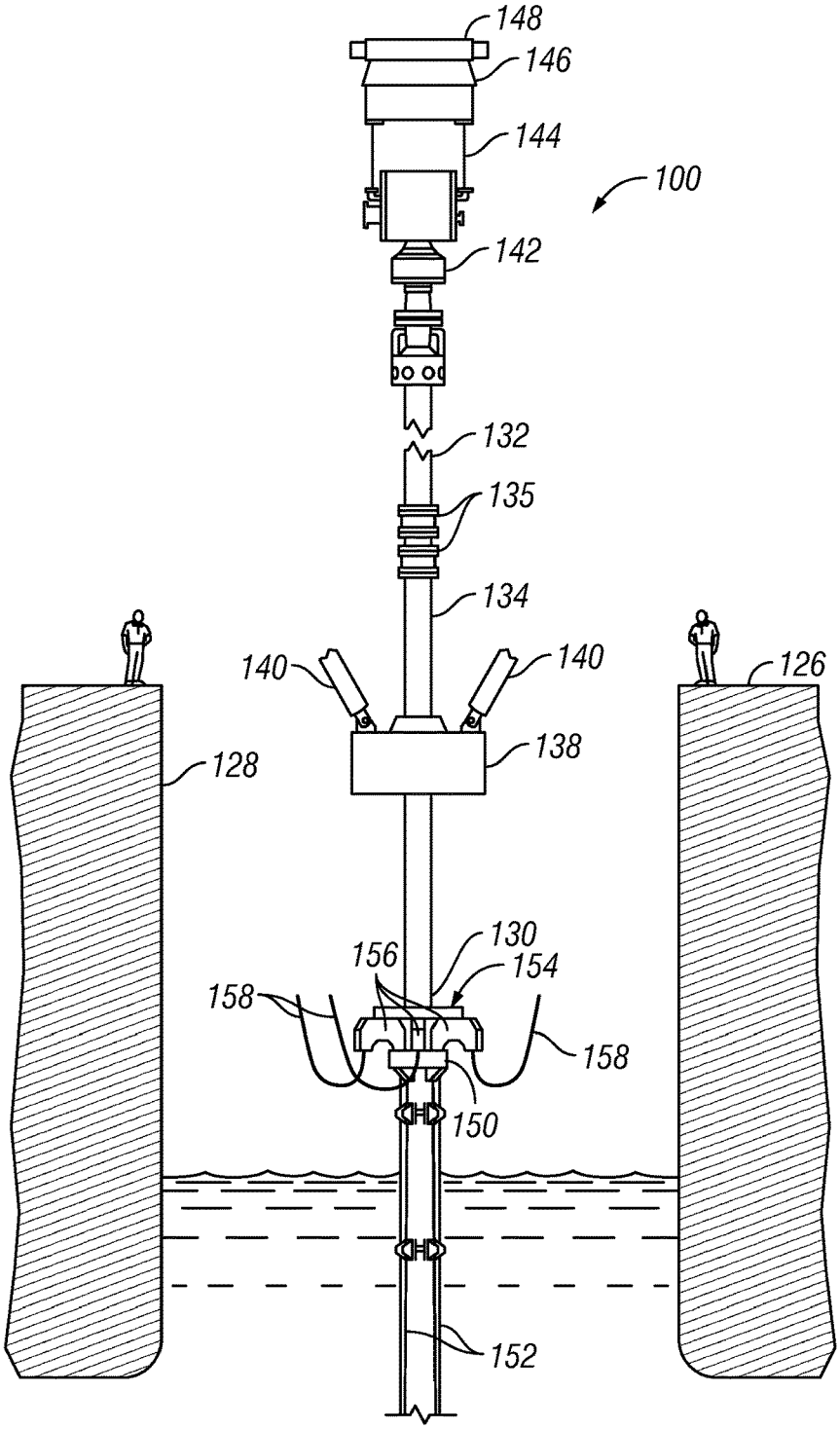
FIGS. 1A-1B show a drilling system including a gooseneck conduit system in accordance with various embodiments.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

The size and weight of the riser joints, and the location of the attachment points of the auxiliary lines to the joints makes installation and/or retrieval of the auxiliary lines a labor-intensive process. Consequently, auxiliary line handling operations can be time consuming and costly. Embodiments of the present disclosure include a gooseneck conduit system that reduces handling time and enhances operational safety. Embodiments of the conduit system disclosed herein can provide simultaneous connection of gooseneck conduits to a plurality of auxiliary fluid lines with no requirement for manual handling or connection operations. Embodiments include hydraulically and/or mechanically operated locking mechanisms that secure the conduit system to the telescoping joint and the auxiliary fluid lines. The conduit system may be hoisted into position on the telescoping joint, and attached to the telescoping joint and the auxiliary fluid lines via the provided locking mechanisms. Thus, embodiments allow gooseneck conduits to be quickly and safely attached to and/or removed from the telescoping joint.

Figure 1B:
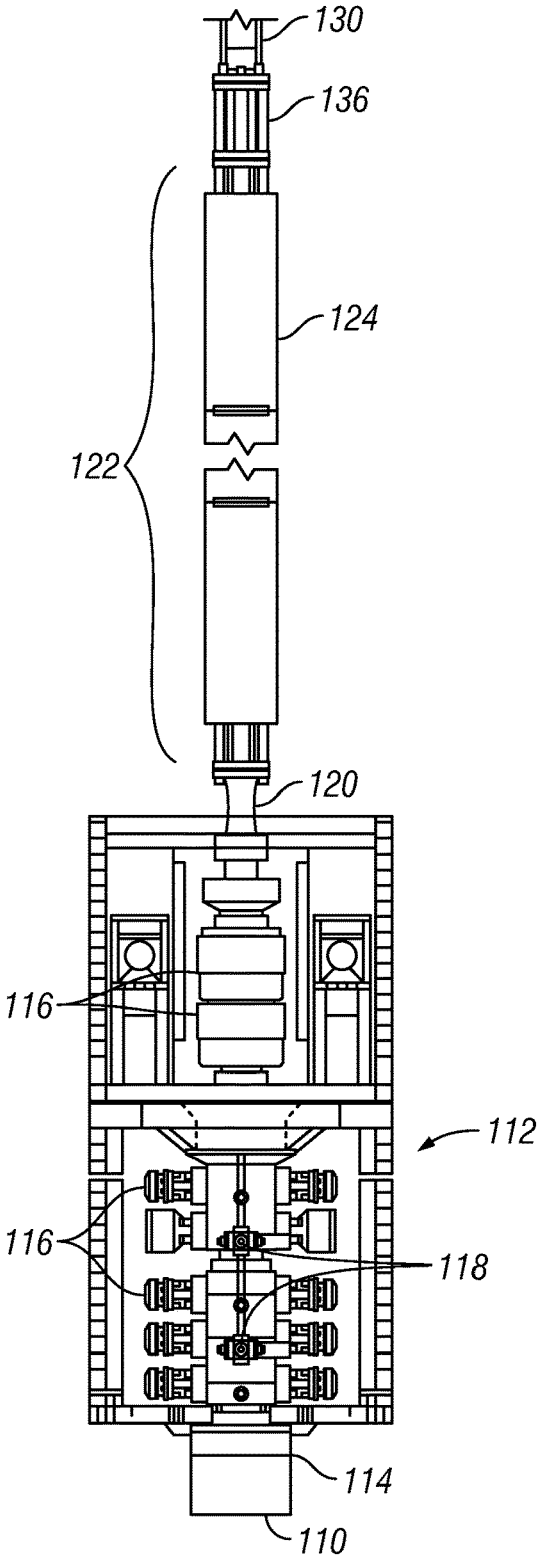

FIGS. 1A-1B show a drilling system 100 in accordance with various embodiments. The drilling system 100 includes a drilling rig 126 with a riser string 122 and a blowout preventer stack 112 used in oil and gas drilling operations connected to a wellhead housing 110. The wellhead housing 110 is disposed on the ocean floor with the blowout preventer stack 112 connected by a hydraulic connector 114. The blowout preventer stack 112 includes multiple blowout preventers 116 and kill and choke valves 118 in a vertical arrangement to control well bore pressure in a manner known to those of skill in the art. Disposed on the upper end of blowout preventer stack 112 is a riser adapter 120 to allow connection of the riser string 122 to the blowout preventer stack 112. The riser string 122 is composed of multiple sections of pipe or riser joints 124 connected end to end and extending upwardly to the drilling rig 126.

The drilling rig 126 further includes a moon pool 128 including a telescoping joint 130 disposed therein. The telescoping joint 130 includes an inner barrel 132 that telescopes inside an outer barrel 134 to allow relative motion between the drilling rig 126 and the wellhead housing 110 while maintaining the riser string 122 in tension. A dual packer 135 is disposed at the upper end of the outer barrel 134 and seals against the exterior of the inner barrel 132. A landing tool adapter joint 136 is connected between the upper end of the riser string 122 and the outer barrel 134 of the telescoping joint 130. A tension ring 138 is secured on the exterior of the outer barrel 134 and connected by tension lines 140 to a hydraulic tensioning system as known to those skilled in the art. This arrangement allows tension to be applied by the hydraulic tensioning system to the tension ring 138 and the telescoping joint 130. The tension is transmitted through the landing tool adapter joint 136 to the riser string 122 to support the riser string 122. The upper end of the inner barrel 132 is terminated by a flex joint 142 and a diverter 144 connecting to a gimbal 146 and a rotary table spider 148.

A support collar 150 is coupled to the telescoping joint 130, and the auxiliary fluid lines 152 are connected using seal sub systems (described in detail below) and retained by the support collar 150. One or more gooseneck conduit assemblies 154 are coupled to the support collar 150 and to the auxiliary fluid lines 152 via the seal sub systems retained by the support collar 150. Each conduit assembly 154 is a conduit unit that includes one or more gooseneck conduits 156. A hose 158 or other fluid line is connected to each gooseneck conduit 156 for transfer of fluid between the gooseneck conduit 156 and the drilling rig 126. In some embodiments, the connections between the hoses 158 and/or other rig fluid lines and the gooseneck conduits 156 are made on the rig floor, and thereafter the gooseneck conduit assemblies 154 are lowered onto the telescoping joint 130. The conduit assemblies 154 can be lowered onto the support collar 150 using a crane or hoist.

Figure 2:
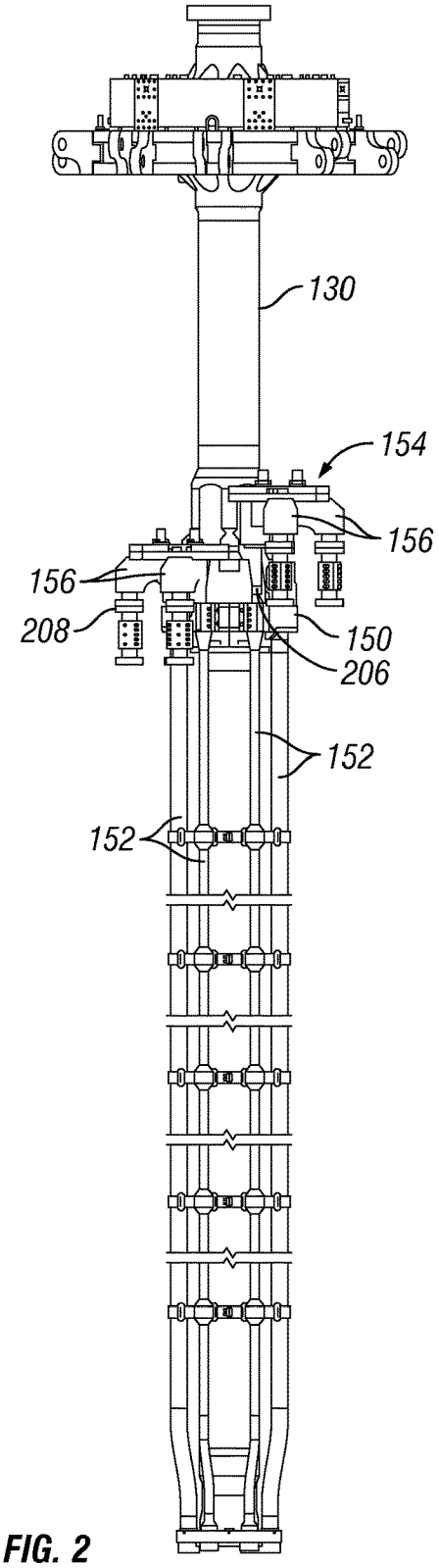
FIG. 2 shows a telescoping joint in accordance with various embodiments.

FIG. 2 shows the telescoping joint 130 in accordance with various embodiments. The auxiliary fluid lines 152 are secured to the telescoping joint 130. The uphole end of each auxiliary fluid line 152 is coupled to a seal sub 206 at the support collar 150. The support collar 150 is coupled to and radially extends from the telescoping joint 130. In some embodiments, the support collar 150 includes multiple connected sections (e.g., connected by bolts) that join to encircle the telescoping joint 130.

The gooseneck conduit assemblies 154 each include one or more locking mechanisms and a gooseneck conduit 156. As the gooseneck conduit assemblies 154 are positioned on the support collar 150, each gooseneck conduit 156 engages a seal sub 206 and is coupled to an auxiliary fluid line 152. The locking mechanisms secure the gooseneck conduit assemblies 154 to the support collar 150, and secure each gooseneck conduit 156 to a corresponding auxiliary fluid line 152. The gooseneck conduits 156 may include swivel flanges 208 for connecting the conduits 156 to the fluid lines 158.

Figure 3:
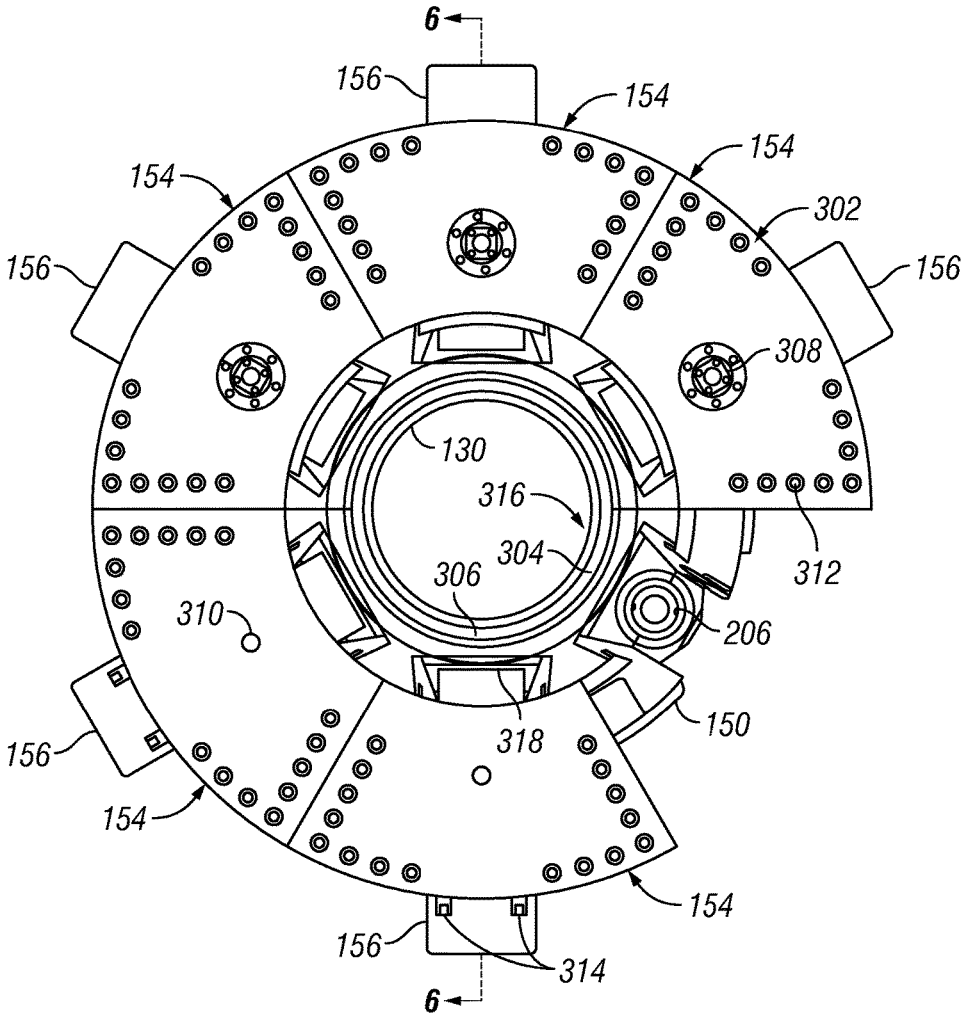
FIG. 3 shows a top view of a plurality of gooseneck conduit assemblies in accordance with various embodiments.

FIG. 3 shows a top view of a plurality of gooseneck conduit assemblies 154 in accordance with various embodiments. Each gooseneck conduit assembly 154 includes one or more gooseneck conduits 156. Each gooseneck conduit assembly 154 includes a top plate 302 and fasteners 312 that connect the top plate 302 to the underlying structures explained below. The gooseneck conduit assembly 154 includes a projection or tenon 306 for aligning and locking the gooseneck conduit assembly 154 to the telescoping joint 130. Some embodiments of the gooseneck conduit assemblies 154 include a tenon 306 coupled to each gooseneck conduit 156. In some embodiments, the tenon 306 may be trapezoidal, or fan-shaped to form a dove-tail tenon. Other embodiments may include a differently shaped tenon 306. The tenon 306 may be formed by a bumper attached to the rear face 318 of the gooseneck conduit 156, with the bumper, and thus the tenon 306, extending along the length of the rear face 318. In some embodiments, the tenon 306 may be made of bronze or another suitable material. In some embodiments, the tenon 306 may be part of the gooseneck conduit 156.

An alignment guidance ring 316 is circumferentially attached to the telescoping joint 130. The alignment guidance ring 316 includes channel mortises 304 that receive and guide the gooseneck conduits 156 into alignment with the seal sub systems 204, and retain the tenons 306 as the gooseneck conduit assembly 154 is lowered onto the telescoping joint 130. Consequently, the mortises 304 are shaped to mate with and slidingly engage the tenons 306 (i.e., a trapezoids, dove-tails, etc.). The channel mortises 304 may narrow with proximity to the support collar 150 (with proximity to the bottom of the alignment ring 316). Similarly, the tenons 306 may narrow with distance from the top plate 302 (with proximity to the bottom of the rear face 318 of the gooseneck conduit 156). The tenons 306 and mortises 304 are dimensioned to securely interlock.

Each gooseneck conduit assembly 154 includes one or more locking mechanisms that secure the gooseneck conduit assembly 154 to the telescoping joint 130. Embodiments may include one or more locking mechanisms that are mechanically or hydraulically actuated. For example, embodiments may include a primary and a secondary locking mechanism. Hydraulic secondary backup locks 308 are included on some embodiments of the gooseneck conduit assembly 154. The hydraulic secondary locks include a hydraulic cylinder that operates the lock. Other embodiments include mechanical secondary backup locks 310. In some embodiments, the secondary backup locks secure the primary locking mechanisms into position. Lock state indicators 314 show the state of conduit assembly locks. For example, extended indicators 314 indicate a locked state, and retracted indicators 314 indicate an unlocked state.

Figure 4:
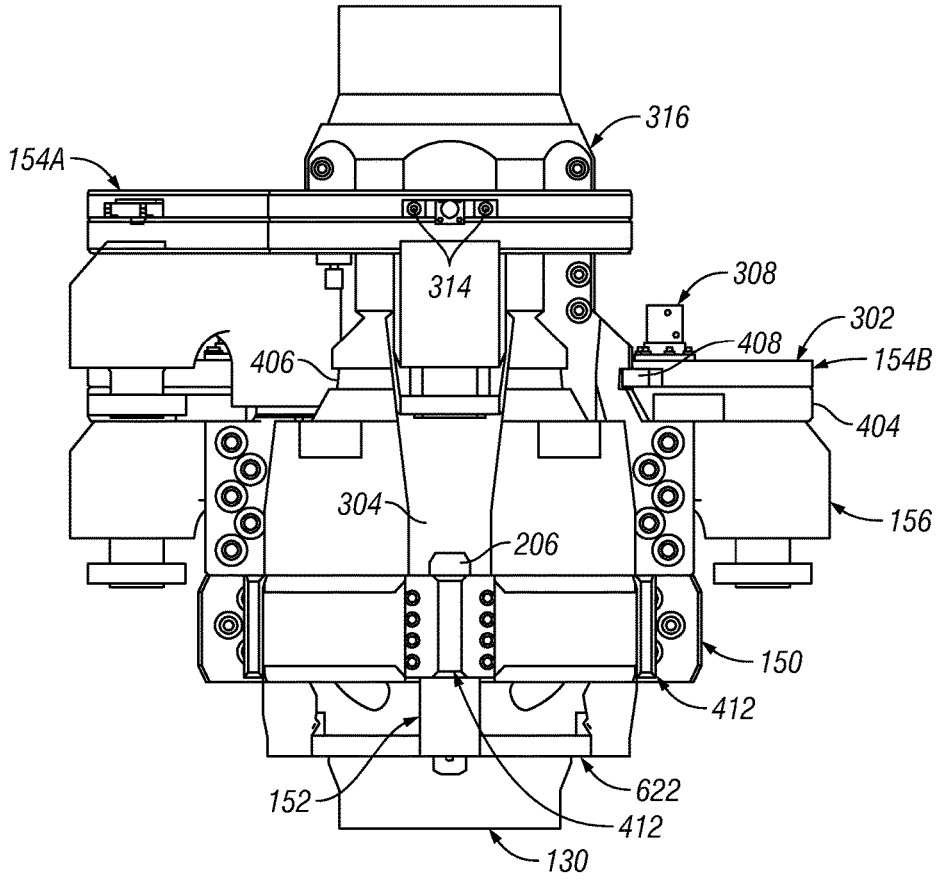
FIG. 4 shows an elevation view of a support collar and gooseneck conduit assemblies in accordance with various embodiments.

FIG. 4 shows an elevation view of the support collar 150 and the gooseneck conduit assemblies 154 in accordance with various embodiments. The gooseneck conduit assembly 154A is shown unlocked and separated from the telescoping joint 130, positioned above the support collar 150. The gooseneck conduit assembly 154B is secured to the telescoping joint 130 and associated seal sub systems 204. Each gooseneck conduit 156 is replaceably fastened to a lower support plate 404 by bolts or other attachment devices. The upper support plate 302 is attached to the lower support plate 404. The support collar 150 retains the seal sub systems via clamps 412 attached to the support collar 150 by bolts or other fastening devices.

The alignment and guidance ring 316 is secured to the telescoping joint 130. The alignment and guidance ring 316 may be formed from a plurality of ring sections joined by bolts or other fastening devices. The alignment and guidance ring 316 includes a locking channel 406. The gooseneck conduit assembly 154B rests on surface 502 (FIG. 5) of the alignment and guidance ring 316, and as discussed above, the tenons 306 interlock with the mortises 304 to laterally secure the gooseneck conduit assembly 154B. The locking member 408 extends from the gooseneck conduit assembly 154B into the locking channel 406 to prevent movement of the gooseneck conduit assembly 154B upward along the telescoping joint 130.

Figure 5:
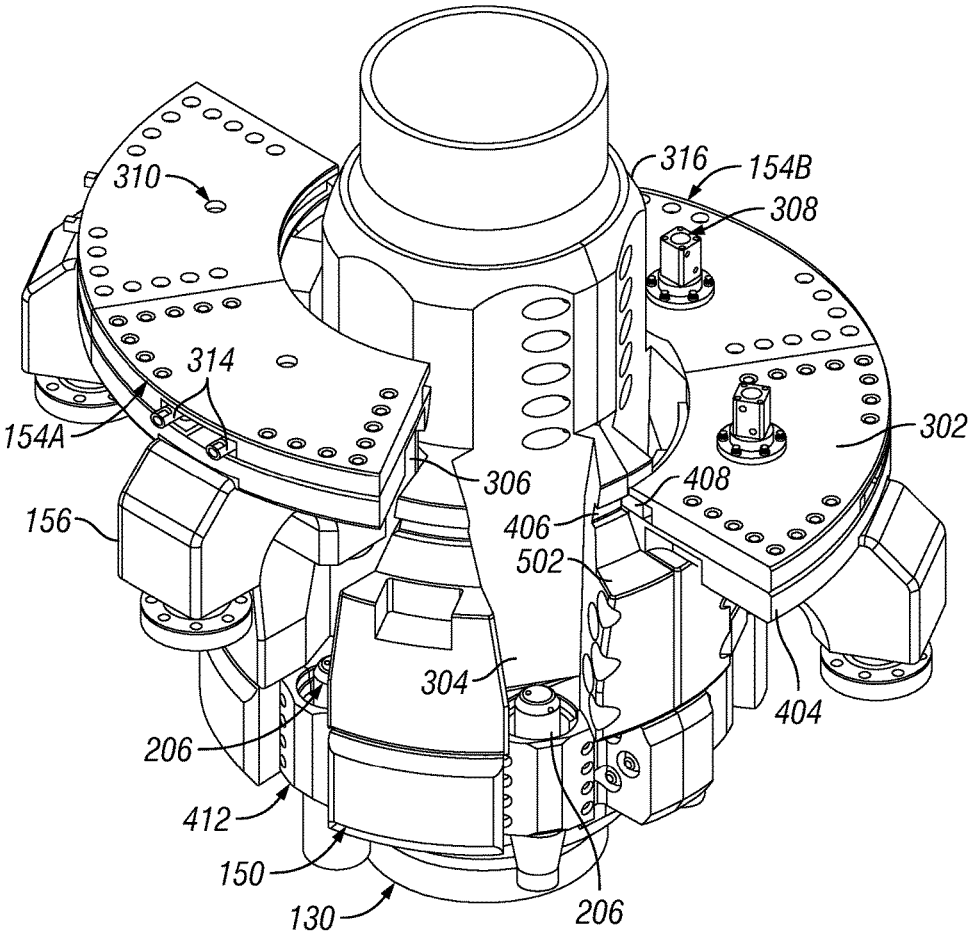
FIG. 5 shows a perspective view of a support collar and gooseneck conduit assemblies in accordance with various embodiments.

FIG. 5 shows a perspective view of the support collar 150 and the gooseneck conduit assemblies 154 as arranged in FIG. 4.

Figure 6:
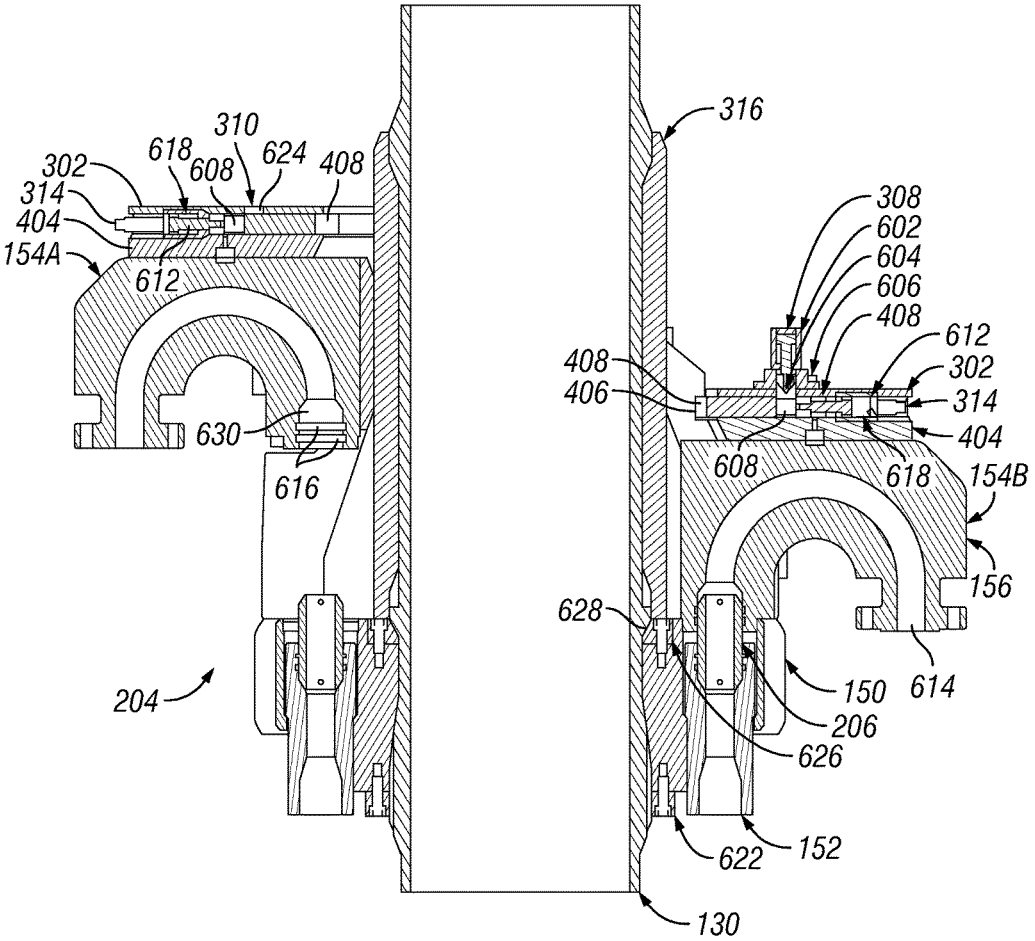
FIG. 6 shows a cross sectional view of a support collar and gooseneck assemblies in accordance with various embodiments.

FIG. 6 shows a cross-sectional view of the support collar 150, the gooseneck conduit assemblies 154, and the seal sub systems 204 as arranged in FIG. 4. Embodiments of the gooseneck conduits assemblies 154 may include any combination of hydraulic and mechanical primary and secondary locks. The gooseneck conduit assembly 154B includes a hydraulic primary lock 618 and a hydraulic secondary lock 308. The components of the hydraulic primary lock 618 are disposed between the upper and lower support plates 302 and 404. The hydraulic primary lock 618 includes a hydraulic cylinder 612 coupled to the locking member 408 for extension and retraction of the locking member 408.

The components of the hydraulic secondary lock 308 are secured to the upper plate 302 by hydraulic cylinder support plate 606. The hydraulic secondary lock 308 includes a hydraulic cylinder 602 coupled to a locking pin 604 for extension and retraction of the locking pin 604. When the locking member 408 has been extended, extension of the locking pin 604 secures the locking member 408 in the extended position. In some embodiments, the locking member 408 includes a passage 608. The locking pin 604 extends into the passage 608 to secure the locking member 408 in the extended position.

The gooseneck conduit assembly 154A includes a hydraulic primary lock 618 and a mechanical secondary lock 310. As described above, the components of the hydraulic primary lock 618, including the hydraulic cylinder 612, and the locking member 408, are disposed between the upper and lower support plates 302 and 404. In some embodiments, the locking member 408 may be retracted by mechanical rather than hydraulic means. For example, force may be applied to the state indicator 314 to retract the locking member 408 from the locking channel 406. The mechanical secondary lock 310 comprises an opening 624 that allows a bolt or retention pin to be inserted into the passage 608 of the locking member 408 when the locking member 408 is extended.

An upper split retainer 626 and a lower split retainer 622 are attached to the support collar 150 to reduce support collar 150 radial loading. The upper split retainer 626 is bolted to the upper side of the support collar 150, and the lower split retainer 622 is bolted to the lower side of the support collar 150. Each split retainer 626, 622 comprises two sections. The two sections of each retainer 626, 622 abut at a position 90° from the location where the support collar sections are joined. The upper split retainer 626 includes a tapered surface 628 on the inside diameter that retains and positions the support collar 150 on the telescoping joint 130.

The support collar 150 also includes a key structure (not shown) for aligning the support collar 150 with a keying structure of the telescoping joint and preventing rotation of the support collar 150 about the telescoping joint 130.

Each gooseneck conduit 156 includes an arcing passage 614 extending through the gooseneck conduit 156 for passing fluid between the auxiliary fluid line 152 and the hose 158. The gooseneck conduit assembly 156 may be formed by a casting process, and the thickness of material between the passage 614 and the exterior surface of the gooseneck conduit 156 may exceed the diameter of the passage 614 (by 2-3 or more times in some embodiments) thereby enhancing the strength and service life of the gooseneck conduit 156.

As described above, the auxiliary fluid lines 152 are connected using seal sub systems 204 and retained by the support collar 150. The seal sub systems 204 may be used to connect the fluid lines 152 on adjacent riser string joints or to connect the fluid lines 152 to the gooseneck conduits 156. It should also be appreciated that the seal sub systems may be used with any riser or other subsea drilling equipment fluid line connections, including being used with gooseneck assemblies of different design than the one discussed above.

Figure 7A:
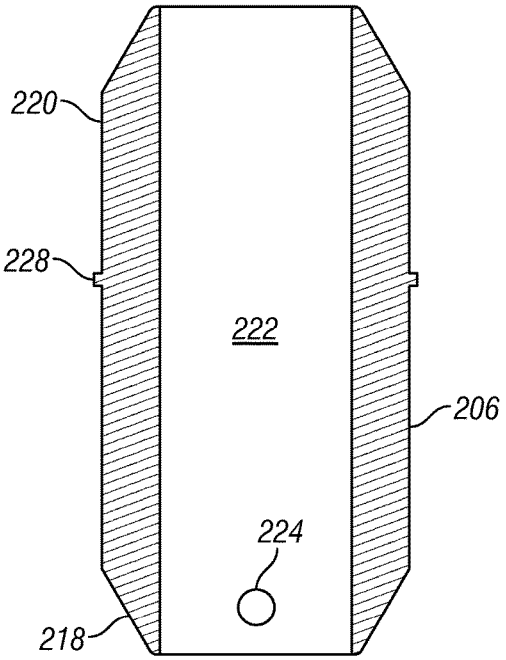
FIGS. 7A-7C show different views of a seal sub in accordance with various embodiments.
Figure 7B:
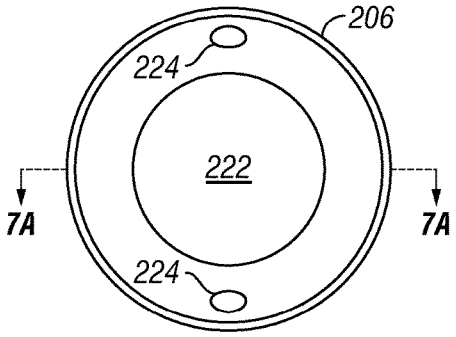
Figure 7C:
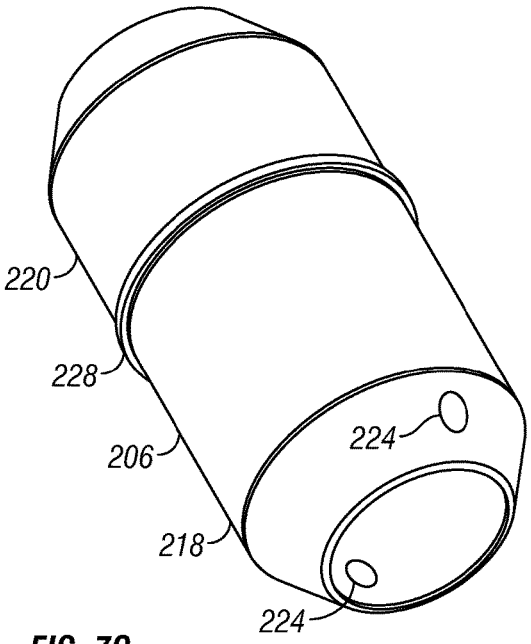
Figure 8:
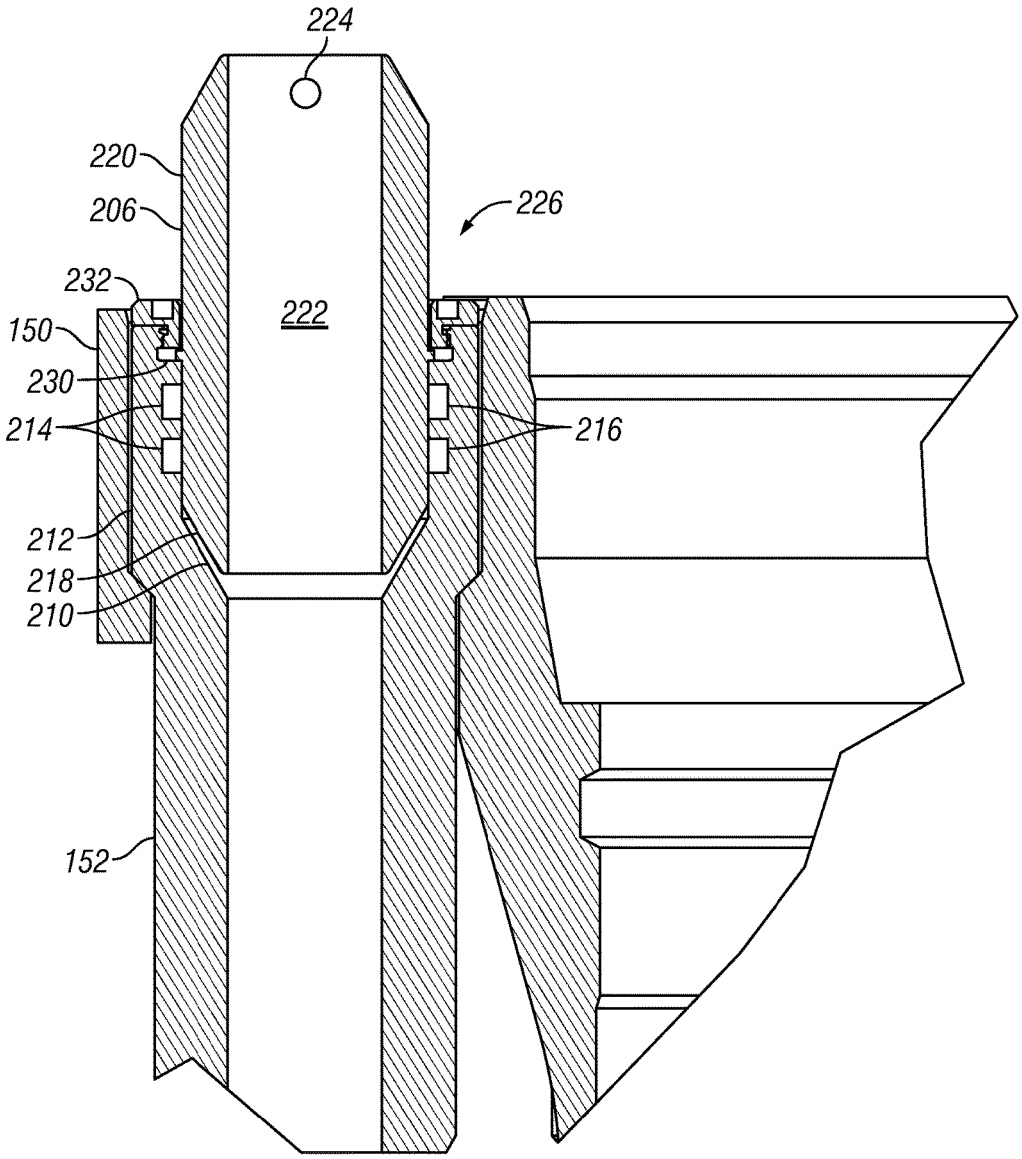
FIG. 8 shows a close up cross sectional view of a seal sub installed in a support collar.

As shown in FIGS. 6-8, the seal sub systems 204 include the hollow fluid lines 152, each with a box 210 at their terminal ends 212. The fluid lines shown in this example are the auxiliary lines 152 from the telescoping joint 130. However, again, it should be appreciated that the fluid lines may be the auxiliary lines from other sections of the riser string 122 or any other fluid line connections of the drilling system 100. The fluid line terminal ends 212 include a shoulder and section of increased diameter that fits into a matching channel and shoulder of the support collar 150. The shoulders are such that the terminal end 212 is supported by the support collar 150 when inserted through the support collar 150. At least one groove 214 is cut into the inner diameter of the hollow fluid line 154 to hold a seal or seals 216 for sealing against the seal sub 206. The seal 216 may be any type of suitable seal configuration, such as a composite seal (e.g., POLYPAK® seal), o-ring, seal cartridge, and the like. The seal 216 may also be of any suitable material, such as metal, elastomer, composite, or other type of material. Alternatively, the groove 214 and the seal 216 may be located on the seal sub 206 itself, with the inner diameter of the terminal end 212 being a smooth bore (shown below in FIG. 9).

Removably inserted in the box 210 of the fluid line 152 is the seal sub 206. The seal sub 206 includes a first pin end 218 insertable into the box 210 and a second pin end 220 that extends from the fluid line terminal end 212 when installed. The seal sub 206 can be any suitable material, such as metal, elastomer, composite, or other type of material for providing the structural support of the fluid connection. The seal sub 206 includes an inner, hollow channel 222 extending through the seal sub 206 that aligns with the channel of the fluid line 152 to allow fluid communication from one fluid line to another. As shown, the seal sub 206 includes chamfered ends for ease of installation and connection make-up. However, the ends need not include the chamfers as shown. Optionally, the seal sub 206 may also include holes 224 at various locations of the inner channel 222. The holes 224 allow for the insertion of a rod or other tool used for handling the seal subs 206 during installation and removal from the fluid line 152.

A retainer 226 releasably retains the seal sub 206 in the fluid line 152. The retainer 226 is designed to release the seal sub 206 for removal of the seal sub 206 from the fluid line 152 without the need to remove the fluid line 152 from the support collar 150. In this way, the seal subs 206 and the seals 216 may be inspected, refurbished, or replaced without having to remove the entire fluid line 152 from the riser section. The retainer 226 may be a suitable design for releasably retaining the seal sub 206. As shown in FIGS. 7A-8, the seal sub 206 includes a flange 228 radially extending from the outer surface of the seal sub 206. Although shown as annular, the flange 228 may be one or more radially extending portions. The flange 228 is wider than a shoulder 230 on the inner diameter of the fluid line 152 such that the flange 228 may not pass the shoulder 230. The retainer 226 also includes a retaining ring 232 that threads into the terminal end 212 of the fluid line 152. The inner diameter of the retaining ring 232 is large enough to pass over the body of the seal sub 206, but not large enough to pass over the seal sub flange 228. When threaded into the terminal end 212, the retaining ring 232 thus releasably retains the seal sub 206 in the terminal end 212 of the fluid line 152 by holding the flange 228 between the terminal end shoulder 230 and the retaining ring 232. The retaining ring 232 may also include bosses, holes, or other designs to allow a tool to engage the retaining ring 232 and thread it in place.

As shown in FIG. 6, to complete the connection, a second fluid line is inserted onto the seal sub second pin end 220 to establish a sealed fluid connection. In this example, the connection is established between the auxiliary fluid line 152 and the gooseneck conduit 156, with fluid flowing through the seal sub inner channel 222. The gooseneck conduit 156 includes a socket 630 that sealingly mates with the seal sub 206 to couple the gooseneck conduit 156 to the auxiliary fluid line 152. The socket 630 includes grooves 616 for holding a sealing device that may be similar to the seal 216 in the terminal end of the auxiliary fluid line 152, such as an O-ring, that seals the connection between the gooseneck conduit 156 and the seal sub 206. In the same manner, the seal sub system may be used for other fluid line connections on the drilling system 100, such as connections between auxiliary lines 152 on adjacent sections of the riser string 122.

The seal sub and retainer may be designed in a number of different alternative embodiments. For example, the seal sub may be designed to engage the inner diameter of the fluid line 152 with an interference fit without the need for a separate retainer to hold the seal sub in place. In this example, the flange 228 need not be included. Other examples of alternative designs may include those shown in FIGS. 9-13B discussed below.

Figure 9:
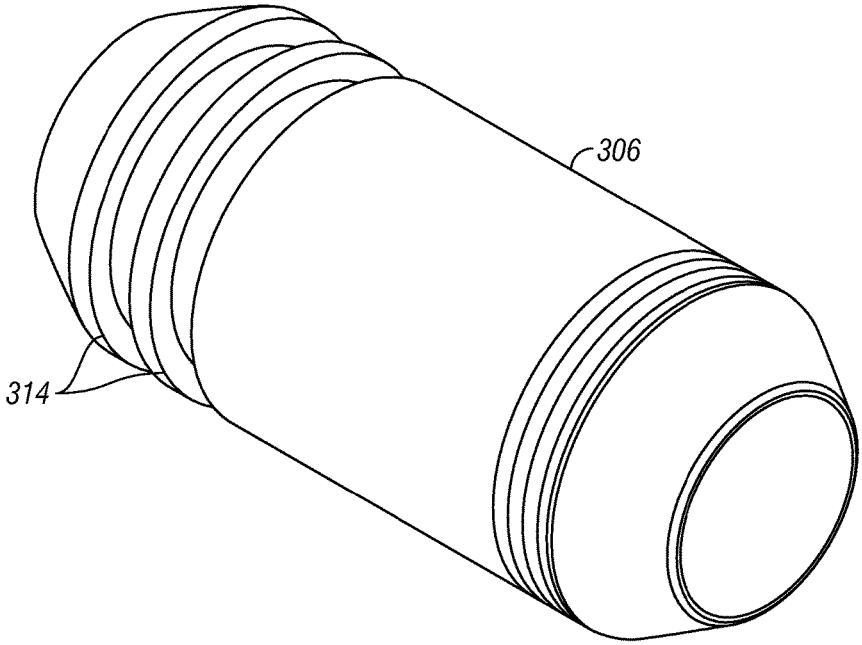
FIG. 9 shows a perspective view of an alternative seal sub in accordance with various embodiments.

FIG. 9 shows an alternative design seal sub 306. Instead of seals in the inner diameter of the fluid line 152, the seal sub 306 includes seals or seal packs (not shown) in grooves 314 in the seal sub 306 itself. With the grooves 314 and the seals in the seal sub 306, the inner diameter of the terminal end 212 of the fluid line may be a smooth bore. Also, the seal sub 306 of the seals placed in the grooves 314 may engage the inner diameter of the fluid line 152 with an interference fit, thus removing the need to include an annular flange.

Figure 10A:
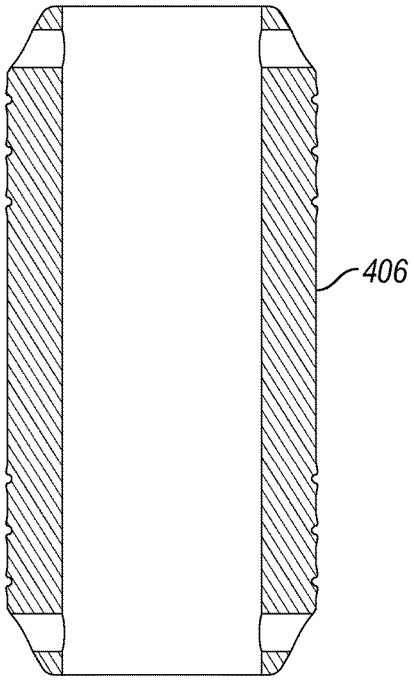
FIGS. 10A-10C show different views of an alternative seal sub in accordance with various embodiments.
Figure 10B:
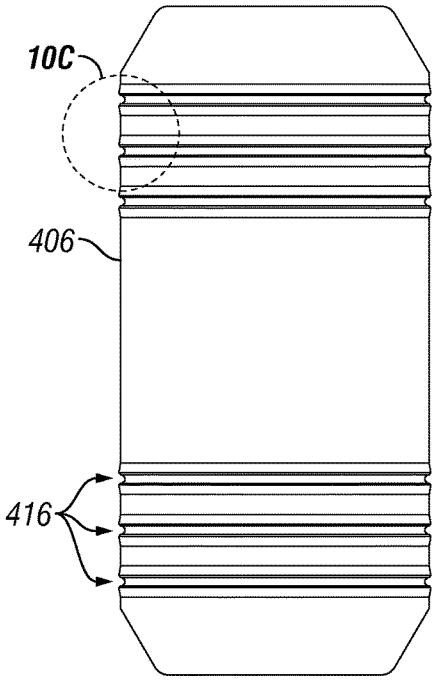
Figure 10C:
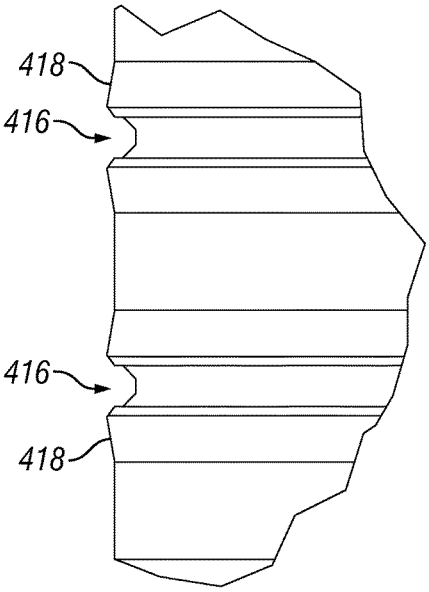

FIGS. 10A-C show another alternative design seal sub 406. The seal sub 406 includes seals 416 that may be integral with or attached to the remainder of the seal sub 406. The seals 416 may be the same material as the remainder of the seal sub 406 or a different material suitable for sealing. The seals 416 include raised surfaces 418 shown more clearly in FIG. 10C (inset from FIG. 10B) that press fit against the inner diameter of the fluid line 152 to form a seal. This design also allows the inner diameter of the terminal end 212 of the fluid line to be a smooth bore. Alternatively, the raised surfaces 418 my be included on the inner diameter of the terminal end 212 of the fluid line 152 rather than the outer surface of the seal sub 406.

Figure 11:
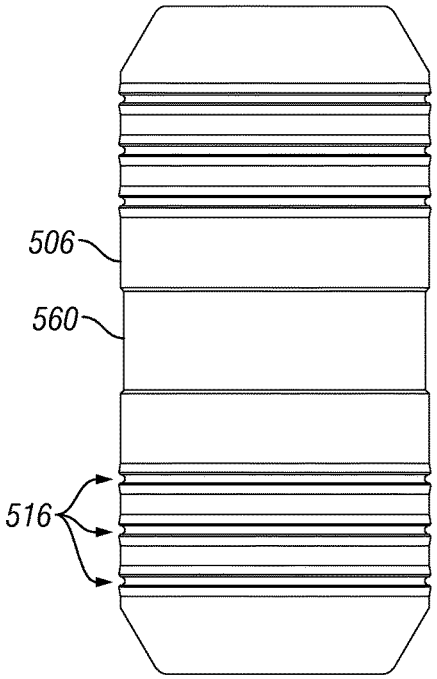
FIG. 11 shows an alternative seal sub in accordance with various embodiments.

FIG. 11 shows another alternative seal sub 506. Seal sub 506 is similar to the seal sub 406 with the inclusion of seals 516 with raised surfaces that press fit against the inner diameter of the fluid line 152 to form a seal. Additionally, the seal sub 506 includes an annular groove 560 around the outer surface. The annular groove 560 enables the use of a split retainer ring that can be bolted onto the terminal end 212 of the fluid line 152 for retaining the seal sub 506 in place.

Figure 12A:
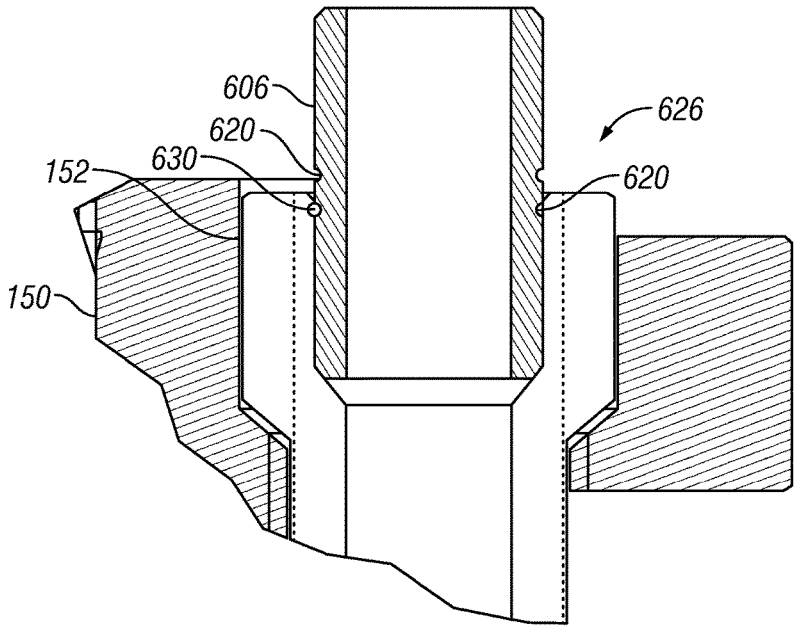
FIGS. 12A-E show different views of an alternative seal sub and retainer in accordance with various embodiments.
Figure 12B:
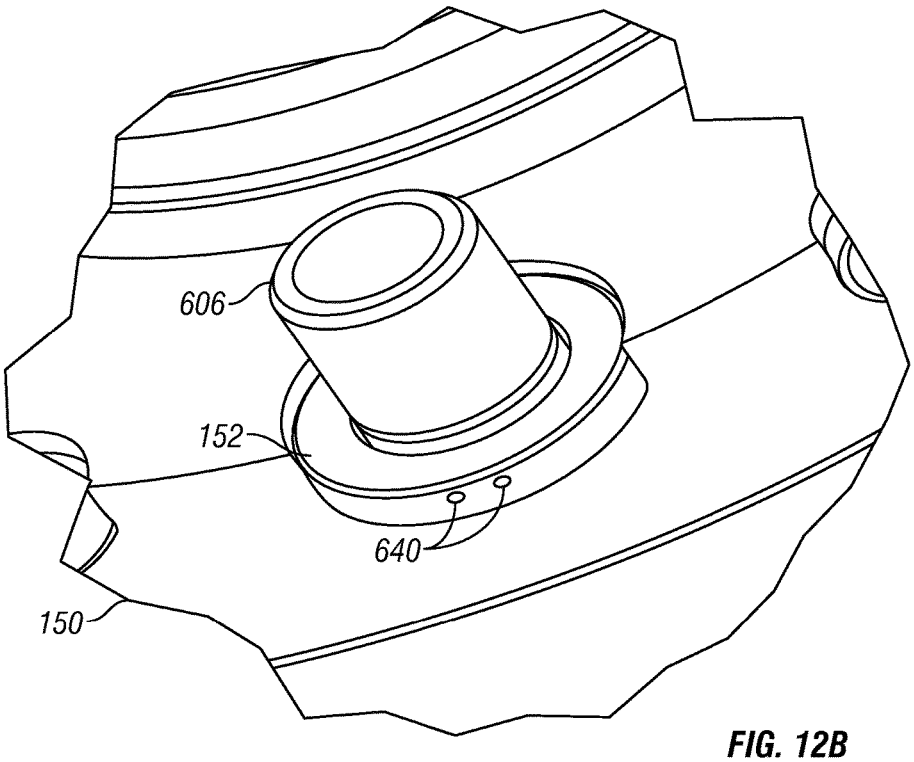
Figure 12C:
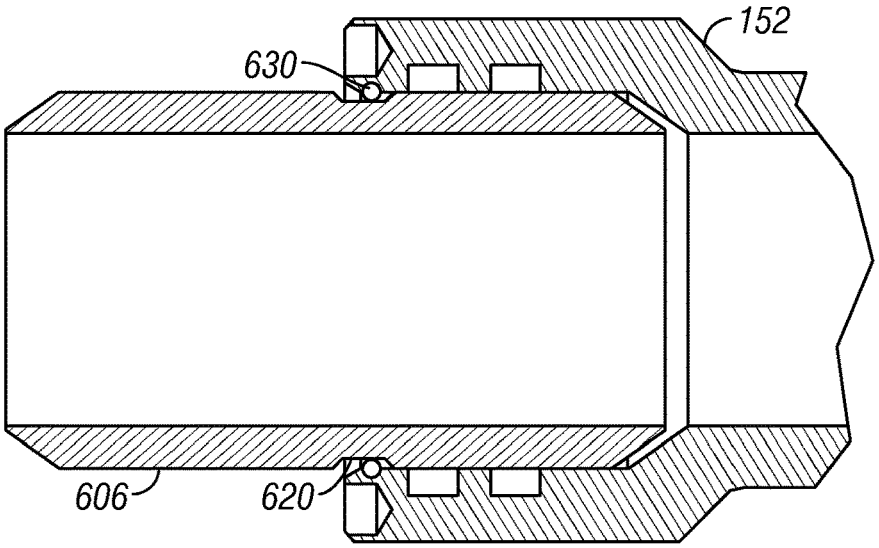
Figure 12D:
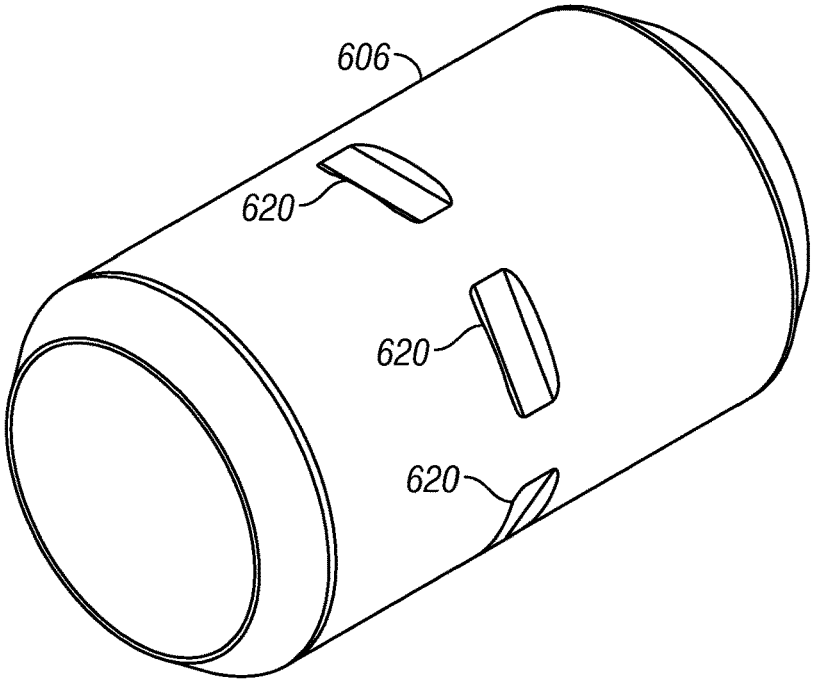
Figure 12E:
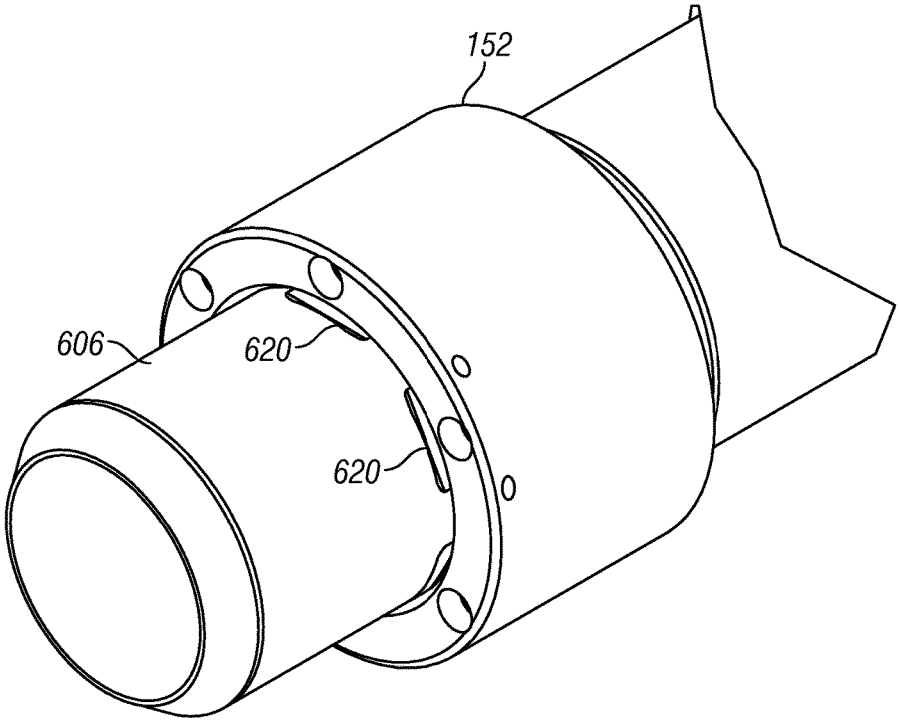

FIGS. 12A-E show another alternative design seal sub 606 and retainer 626. The seal sub 606 includes channels 620 (FIG. 12A) formed around the outer surface of the seal sub 606. As shown in FIGS. 12A and B, the channels 620 may be annular around the outer surface of the seal sub 606. Alternatively, as shown in FIGS. 12C and D, the channels 620 may be sections spaced out around the outer surface of the seal sub 606. Also, the fluid line 152 includes channels 640 that extend through an intersect the inner diameter of the fluid line 152. The channels are arranged at approximately 120 degrees relative to each other, with the adjacent openings slightly spaced apart as shown in FIG. 12B. Alternatively, there may be an appropriate amount of channels 640 angled as needed for the amount of channel sections 620 shown in FIGS. 12C and D. The support collar 150 is designed to expose a portion of the side of the fluid line 152 to expose at least two of the channel 640 openings. Retainer rods or wires 630 may be inserted and extended through the channels 640 to engage one of the seal sub channels 620. In this manner, the rod 630 is anchored to the fluid line 150 by the channel 640 but is exposed to and extends into a portion of a channel of the seal sub 606, holding the seal sub 606 in place. With the channels 640 spaced around the fluid line 152 and a portion of the side of the fluid line 152 exposed, at least one channel 640 opening will be accessible for a rod 630 at any rotational orientation within the support collar 150.

Figure 13A:
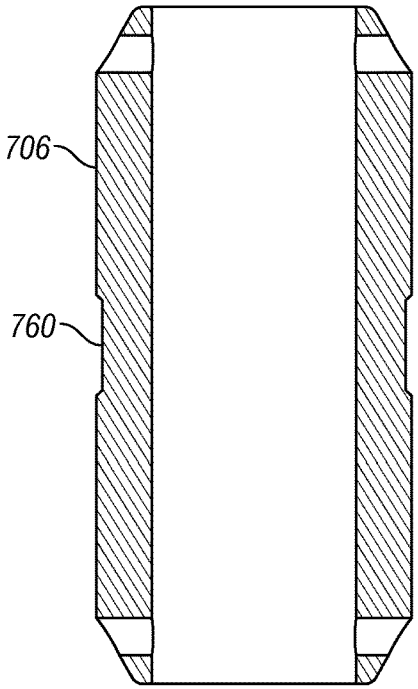
FIGS. 13A-E show different views of an alternative seal sub in accordance with various embodiments.
Figure 13B:
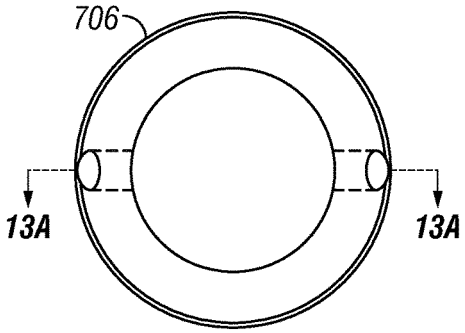
Figure 13C:
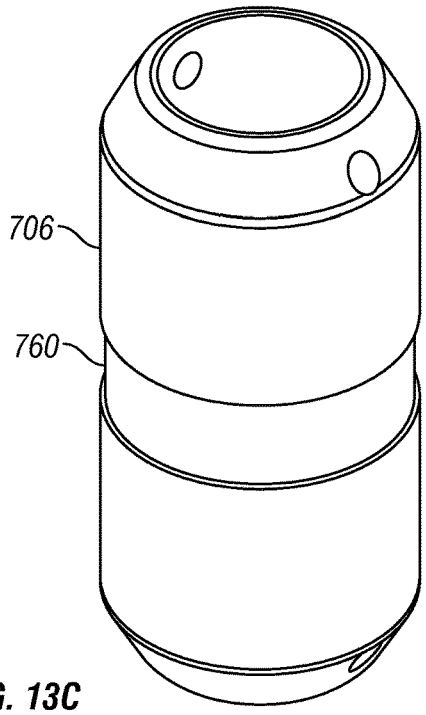
Figure 13D:
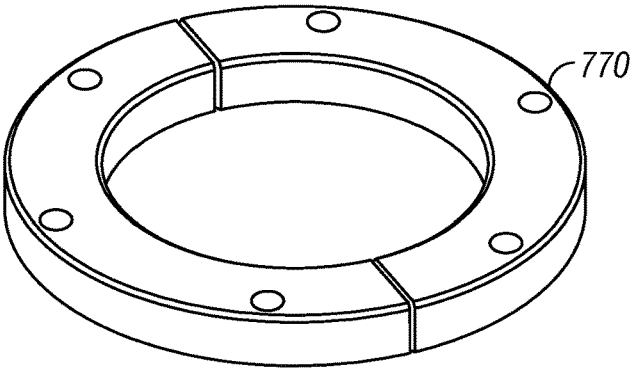
Figure 13E:
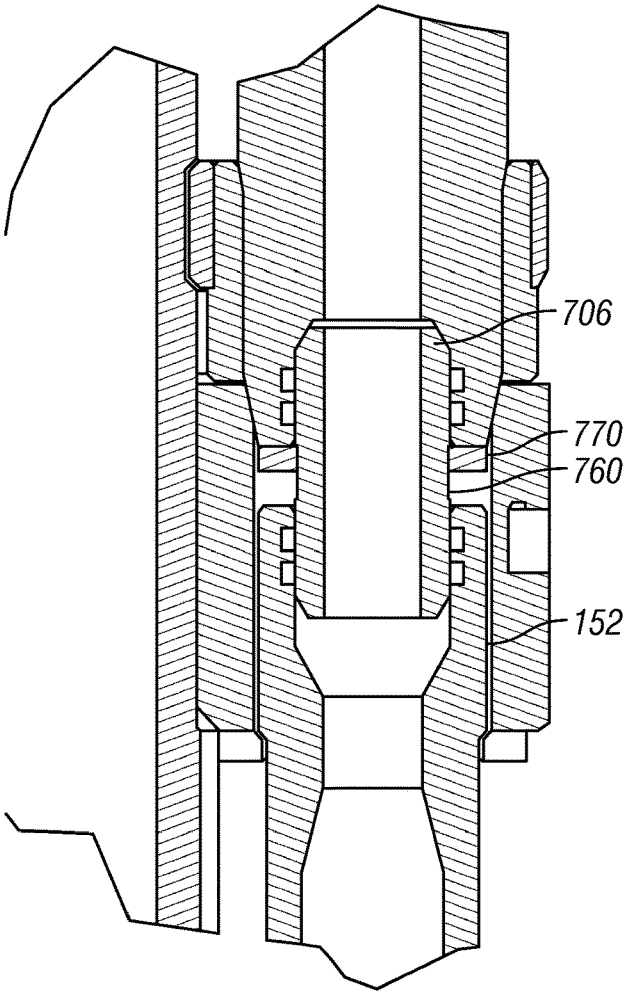

FIGS. 13A-C show another alternative seal sub 706. Similar to seal sub 506, the seal sub 706 includes an annular groove 760 around the outer surface. As described above, the annular groove 760 enables the use of a split retainer ring 770 that can be bolted onto the terminal end 212 of the fluid line 152 for retaining the seal sub 506 in place.

Although the present invention has been described with respect to specific details, it is not intended that such details should be regarded as limitations on the scope of the invention, except to the extent that they are included in the accompanying claims.

What is claimed is:

1. A seal sub system for the connection of auxiliary fluid lines configured to attach to a riser section through a support collar to support the auxiliary fluid lines, the seal sub system including:

the support collar;

a first auxiliary fluid line configured to be supported by the support collar and including a terminal end with a first inner diameter and a shoulder and a second auxiliary fluid line including a terminal end with a second inner diameter;

a seal sub including a body, an inner channel formed through the body, a flange extending radially from the body, and first and second pin ends, the first pin end configured to be slidingly removably insertable in the first auxiliary fluid line terminal end with the flange wider than the shoulder such that the flange may not pass the shoulder and with the second pin end extending from the first auxiliary fluid line terminal end, the second pin end configured to be slidingly removably insertable in the second auxiliary fluid line terminal end;

a retainer configured to be received within the support collar and engage the first auxiliary fluid line terminal end and the flange such that the flange is positioned between the retainer and the shoulder to releasably retain the seal sub in the first auxiliary fluid line;

a seal element positioned and configured to form a seal between the seal sub and the first auxiliary fluid line inner diameter; and wherein the second pin end is configured to be inserted into the terminal end of the second auxiliary fluid line to establish a sealed fluid connection between the first and second auxiliary fluid lines.

2. The seal sub system of claim 1, wherein the retainer is capable of releasing the seal sub for removal of the seal sub from the first auxiliary fluid line.

3. The seal sub system of claim 2, further including:

the retainer including a retaining ring with a retainer inner diameter that allows the seal sub body to pass through the retaining ring but not the flange; and wherein the retaining ring is threadable into the first auxiliary fluid line terminal end so as to hold the flange between the terminal end shoulder and the retaining ring.

4. The seal sub system of claim 3, wherein the flange is annular.

5. The seal sub system of claim 1, further including:

a groove in either an outer surface of the seal sub body or the first auxiliary fluid line inner diameter; and the seal element being capable of fitting within the groove.

6. The seal sub system of claim 1, wherein the support collar comprises a support collar shoulder, and the first auxiliary fluid line comprises a second shoulder that engages the support collar shoulder to enable the first auxiliary fluid line to be supported by the support collar.

7. The seal sub system of claim 1, the seal element including raised annular surfaces on either an outer surface of the seal sub or the first auxiliary fluid line inner diameter.

8. A subsea riser system, including:

a riser section including a support collar;

a first auxiliary fluid line attached to the riser section and supported by the support collar, the first auxiliary fluid line including a terminal end with a first auxiliary fluid line inner diameter and a shoulder;

a second auxiliary fluid line including a terminal end with a second auxiliary fluid line inner diameter;

a seal sub including a body, a hollow, inner channel formed through the body, a flange extending from the body, and first and second pin ends, the first pin end configured to be slidingly removably insertable in the first auxiliary fluid line terminal end with the flange wider than the shoulder such that the flange may not pass the shoulder and with the second pin end extending from the first auxiliary fluid line terminal end, the second pin end configured to be slidingly removably insertable in the second auxiliary fluid line terminal end;

a retainer configured to be received within the support collar and engage the first auxiliary fluid line terminal end and the flange such that the flange is positioned between the retainer and the shoulder to releasably retain the seal sub in the first auxiliary fluid line;

a seal between the seal sub and the first auxiliary fluid line inner diameter; and wherein the second pin end is configured to be inserted into the terminal end of the second auxiliary fluid line to establish a sealed fluid connection between the first and second auxiliary fluid lines.

9. The subsea riser system of claim 8, wherein the retainer is capable of releasing the seal sub for removal of the seal sub from the first auxiliary fluid line.

10. The subsea riser system of claim 9, further including:

the retainer including a retaining ring with a retainer inner diameter that allows the seal sub body to pass through the retaining ring but not the flange; and wherein the retaining ring is threadable into the first auxiliary fluid line terminal end so as to hold the flange between the terminal end shoulder and the retaining ring.

11. The subsea riser system of claim 10, wherein the flange is annular.

12. The subsea riser system of claim 8, further including:

a groove in either an outer surface of the seal sub body or the first auxiliary fluid line inner diameter; and the seal being formed by a seal element capable of fitting within the groove.

13. The subsea riser system of claim 8, the seal including raised annular surfaces on either an outer surface of the seal sub or the first auxiliary fluid line inner diameter.

14. The subsea riser system of claim 8, wherein the second auxiliary fluid line is either attached to a second riser section or is a gooseneck conduit in a gooseneck assembly.

15. A subsea drilling system including:

a surface platform;

a subsea riser including riser sections and a telescoping joint connected to the platform;

a first auxiliary fluid line attached to one of the riser sections and supported by a support collar by the riser section, the first auxiliary fluid line including a terminal end with a first auxiliary fluid line inner diameter and a shoulder;

a second auxiliary fluid line including a terminal end with a second auxiliary fluid line inner diameter;

a seal sub with a body, a seal sub inner diameter equal to or greater than the first auxiliary fluid line inner diameter including a hollow, inner channel formed through the body, a flange extending radially from the body, and first and second pin ends, the first pin end removably insertable in the first auxiliary fluid line terminal end with the flange wider than the shoulder such that the flange may not pass the shoulder and with the second pin end extending from the first auxiliary fluid line terminal end, the second pin end configured to be slidingly removably insertable in the second auxiliary fluid line terminal end;

a retainer configured to be received within the support collar and engage the first auxiliary fluid line terminal end and the flange such that the flange is positioned between the retainer and the shoulder to releasably retain the seal sub in the first auxiliary fluid line;

a seal between the seal sub and the first auxiliary fluid line inner diameter; and wherein the second pin end is configured to be inserted into the terminal end of the second auxiliary fluid line to establish a sealed fluid connection between the first and second auxiliary fluid lines.

16. The subsea drilling system of claim 15, wherein the retainer is capable of releasing the seal sub for removal of the seal sub from the first auxiliary fluid line.

17. The subsea drilling system of claim 16, further including:

the retainer including a retaining ring with a retainer inner diameter allowing the seal sub body to pass through the retaining ring but not the flange; and the retaining ring being threadable into the first auxiliary fluid line terminal end so as to hold the flange between the terminal end shoulder and the retaining ring.

18. The subsea drilling system of claim 17, wherein the flange is annular.

19. The subsea drilling system of claim 15, further including:

a groove in either an outer surface of the seal sub body or the first auxiliary fluid line inner diameter; and the seal being formed by a seal element capable of fitting within the groove.

20. The subsea drilling system of claim 15, the seal including raised annular surfaces on either an outer surface of the seal sub or the first auxiliary fluid line inner diameter.

21. The subsea drilling system of claim 15, wherein the second auxiliary fluid line is either attached to another riser section or is a gooseneck conduit in a gooseneck assembly.

* * * * *